US005657594A

United States Patent [19]

Morita et al.

[11] Patent Number: 5,657,594

[45] Date of Patent: Aug. 19, 1997

[54] HEAT INSULATION COVERING STRUCTURE OF A LOW TEMPERATURE CARGO TANK

[75] Inventors: Hidetoshi Morita; Yasunori Tomonaga, both of Nagasaki; Hisashi Ogura; Akito Minaki, both of Osaka, all of Japan

[73] Assignees: Mitsubishi Jukogyo Kabushiki Kaisha, Tokyo; Meisei Industrial Co., Ltd., Osaka, both of Japan

[21] Appl. No.: 490,696

[22] Filed: Jun. 16, 1995

[30] Foreign Application Priority Data

Jun. 20, 1994 [JP] Japan ..... 6-160604

[51] Int. Cl.[6] ..... E04B 1/32

[52] U.S. Cl. ..... 52/249; 52/506.05; 52/604; 220/412

[58] Field of Search ..... 52/245, 249, 381, 52/390, 506.01, 506.02, 506.05, 604, 606, 607, 592.5, 692.6; 428/163, 167; 220/412, 459, 467

[56] References Cited

U.S. PATENT DOCUMENTS

| | | | |
|---|---|---|---|
| 3,609,926 | 10/1971 | Muse | 52/604 X |
| 4,180,951 | 1/1980 | Francioni | 52/249 X |
| 4,640,437 | 2/1987 | Weingartner | 52/249 X |
| 4,748,782 | 6/1988 | Johnson et al. | 52/606 X |
| 4,769,961 | 9/1988 | Gillet | 52/245 |
| 4,833,856 | 5/1989 | Zwagerman | 52/604 X |
| 5,131,201 | 7/1992 | Larson et al. | 52/249 X |
| 5,277,580 | 1/1994 | Miskolczi | 52/249 X |
| 5,511,346 | 4/1996 | Kenworthy | 428/167 X |

*Primary Examiner*—Lanna Mai
*Attorney, Agent, or Firm*—Wenderoth, Lind & Ponack

[57] ABSTRACT

The present invention provides a heat insulation covering for a spherical storage tank such as an LNG tank or the like for storing an extremely low temperature liquid. The covering is constructed by using elongated panel-like heat insulating panels. A plurality of slit parts having a U-shaped cross section are formed along the longitudinal direction of a foam-resin heat insulating panel formed in an elongated panel-like configuration. In the slit part, a heat insulating material is inserted. The material has a sufficient expandability under extremely low temperatures. The heat insulating panel can be deformed along the curvature of the surface of the spherical tank. The heat insulation covering of the spherical tank is formed of the heat insulating panels which have an elongated configuration. With such a structure, only a few kinds of heat insulating panels need be prepared, which is favorable in terms of cost.

15 Claims, 10 Drawing Sheets

HEAT INSULATION COVERING STRUCTURE OF A LOW TEMPERATURE CARGO TANK

BACKGROUND OF THE INVENTION

1. Field of the Invention

The present invention relates to a heat insulation covering structure for a cargo tank for containing an extremely low temperature liquefied natural gas (LNG) or the like which requires heat insulation while in storage. The tank structure includes a cylindrical vessel, a rectangular vessel or the like. In particular, the present invention is related to a heat insulation covering structure for a low temperature cargo tank, the structure of which is preferable for the insulation covering of a spherical vessel (spherical tank) used in a LNG cargo ship or the like.

2. Description of the Related Art

Heretofore, with a spherical tank for storing an extremely low temperature LNG at about −160° C., as shown in FIG. 12, many different kinds of heat insulating panels (covering member) 2 are fixed to a tank 1 with a bolt or the like. The panel being developed on a surface of the spherical tank 1, formed of aluminum or the like, for each member of the tank surface and is then processed into a complicated curved surface so as to conform to each member. After that resin such as polyurethane or the like is applied between joining parts of each heat insulating panel 2 to provide heat insulation and covering.

Consequently, a heat insulation covering for a conventional spherical tank, a heat insulating panel 2 is used which is preliminarily fabricated into a configuration which conforms to the shape of each member of the tank surface. In addition, each of the heat insulating panels 2 is formed by assembling in various ways heat insulating materials, reinforcements, and soft heat insulating materials so as to be able to endure extremely low temperatures. Further, there arises a problem in that a large number of manhours are needed for applying the resin-made bonding materials 14 into connection joints to connect each heat insulating panel 2 to another at the time of mounting the heat insulating panels 2.

SUMMARY OF THE INVENTION

The present invention is intended to solve the problems associated with the attachment of conventional heat insulation covering structures for low temperature cargo tanks. At least one or several kinds of heat insulating panels 2 are provided. Additionally, an object of the present invention is to provide a heat insulation covering structure for a low temperature cargo tank, which facilitates the manufacture and control of the heat insulating panel by adopting a simple structure which is able to function in extreme low temperatures. The heat insulating panel structure is formed so that the panel can easily conform to a tank surface which may have a varying curvature thereby reducing the costs of the tank heat insulation covering structure.

To attain the aforementioned object, in a heat insulation covering structure for a low temperature cargo tank, the following structure is adopted.

In the heat insulation covering structure of the low temperature cargo tank, the whole shape is formed into an elongated panel-like shape with the longitudinal axis thereof being parallel (horizontal) with a horizontal axis of the low temperature cargo tank. Each heat insulating panel includes a plurality of equally spaced slit parts. The slit parts have approximately U-shaped cross sections which extend from an adhering side or surface (low temperature side) toward the opposite or outer side (normal temperature side) of the panel.

The heat insulating panel is formed into an elongated panel-like shape. At the same time, a plurality of equally spaced recesses or slits having U-shaped cross sections are formed in the low temperature side toward the normal temperature side. Thus, the heat insulating panel can be easily deformed into a configuration which conforms to the curvature of the tank surface to facilitate mounting of the heat insulating panels.

With such a construction, the heat insulating panels formed of approximately the same material into a single shape or several kinds of simple shapes can be easily manufactured even on a tank surface whose curvature changes drastically. The heat insulation covering structure, which has satisfactory thermal and strength characteristics, is also obtained at the place exposed to an extremely low temperature atmosphere thereby reducing the production costs at factories and construction costs at the site.

Further, the stress, which is generated at the time of deformation of the heat insulating panel, can be dispersed by providing a U-shaped slit part on the heat insulating panel. Because tensile stress generated by thermal stress at the low temperature side is relaxed, an initial compressive stress generated by bending during manufacture is relaxed, and therefore deformation fatigue is avoided with the heat insulating panel which occurs due to motion of the low temperature cargo tank generated with each discharge and emission of temperature cargo into and from the low temperature cargo tank.

Further, in the heat insulation covering structure of the present invention, the aforementioned slit part preferably comprises a U-shaped groove formed on the aforementioned heat insulating panel. A U-shaped plug, fittable into the U-shaped groove or recess, is formed of the same material as the heat insulating panel. A crack arrester material is mounted on the surface of the groove. Also, a heat insulating material, which is expandable and shrinkable under extreme low temperatures, is provided between an inside perimeter of the U-shaped groove and an outside perimeter of the U-shaped plug.

In this manner, the slit part includes a U-shaped groove having a crack arrester formed of glass cloth or the like adhering to the groove surface, a U-shaped plug inserted into the U-shaped groove, and a heat insulating material provided between the U-shaped groove with the crack arrester material adhered to the surface thereof, and the U-shaped plug. The slit part has a gradual U-shape so as not to generate a stress concentration when the heat insulating panel is bent along the curvature of the low temperature cargo tank. At the same time, when the panel is bent along the tank curvature, cracks that might be generated in the heat insulating panel can be prevented due to the crack arrester material.

Further, since the U-shaped slit part includes insulating material, constituted of a polyamide, polyimide, phenol, or melanine heat insulating material which are soft under extreme low temperatures, the heat insulating panel under the extreme low temperature can easily be deformed and convection can be prevented.

Further, the heat insulating material is fabricated to a uniform thickness, and the low temperature side of the heat insulating panel is set to an arbitrary curvature along the tank surface. When the heat insulating panel or material is mounted between the U-shaped groove and the U-shaped plug, the heat insulating panel is compressed. Consequently, the shrinkage of the tank surface due to the cooling of the low temperature cargo is restored and may be expanded when the heat insulating panel is shrunk with the thermal shrinkage thereby alleviating the tensile stress generated in the heat insulating panel.

This enables the heat insulating panel to easily follow the expansion and contraction of the tank surface with the result that the connection part and the slit part of the heat insulating panel can be formed so that concentrations of stress are avoided, and the fatigue strength of the panel is improved.

Further, the heat insulation covering structure preferably includes a U-shaped groove having a crack arrester material adhered to the surface thereof, and a U-shaped plug which is inserted into the U-shaped groove and is formed of a heat insulating material which is weak in compression under extremely low temperatures.

In this manner, by forming the slit part with a U-shaped groove, and a U-shaped plug which is inserted into the U-shaped groove and is formed of a heat insulating material which does not increase in compression force under extreme low temperatures, it will be unnecessary to provide the layer of heat insulating material between the inside perimeter of the U-shaped groove and the outside perimeter of the U-shaped plug. Further, the U-shaped plug exhibits approximately the same operation and effect with the heat insulating material so that the structure of the slit can be simplified. At the same time, similar operation and effect can be obtained as in the case where the heat insulating material is provided between the aforementioned U-shaped groove and the U-shaped plug.

Further, a moisture proof surface material is adhered to the normal temperature side of the aforementioned heat insulating panel. The material includes V-shape and U-shape non-bonding areas which are preferably intermittently located along the longitudinal direction of the heat insulating panel to facilitate bending due to the curvature in the vertical axis direction (perpendicular direction), of the low temperature cargo tank of the heat insulating panel.

In this manner, infiltration of moisture, produced at a surface which is exposed to the atmosphere, into the heat insulating panel and the generation of mechanical damage on the heat insulating panel by cold air can be prevented by sticking the moisture proof surface material on the normal temperature side of the heat insulating panel.

Further, the heat insulating panel can be easily deformed because only compression stress acts on the heat insulating panel because the V-shape or U-shape non-bonding areas of the surface material permits the surface material to float upon deformation of the heat insulating panel.

Since the surface material will not impede the panel curvature, the heat insulating panel can be mounted smoothly at a tank location such as the north pole and the south pole areas of a spherical tank where a circumferential length difference changes abruptly in the vertical axis direction of the low temperature cargo tank.

Further, the heat insulation covering structure can be formed so as to alleviate stress, along with the slit part formed on the low temperature side of the joint part, by providing a non-bonding part.

Further, when the heat insulating panel is bent, warps generated on the outer surface are not absorbed into the non-bonding part. Accordingly, the heat insulating covering structure surface can prevent the generation of cracks on the surface material due to the repeated generation of warps.

Further, in the heat insulation covering structure of the low temperature cargo tank of the present invention, projections and depressions for forming joints in the step direction of the aforementioned heat insulating panels are provided on the upper end surface and the lower end surface of the aforementioned heat insulating panel. The projections and depressions of the heat insulating panels are stacked upwardly and downwardly on each other in steps and are interfitted with each other.

Preferably the heat insulating panels are stacked on each other and are bonded only at normal temperature side areas on the upper end surface and the lower end surface.

In this manner, on the upper end surface and the lower end surface of the heat insulating panels stacked in the vertical axis direction of the low temperature cargo tank, projections and depressions are fit to and joined with projections and depressions provided on respective upper column and lower column heat insulating panels. At the same time, the upper column and the lower column heat insulating panels are bonded only along the normal temperature side part of the joining surface. Consequently, this non-bonding part constitutes a slit, and opens somewhat when a vertical pulling stress acts on the low temperature side, thereby alleviating the stress in the stacking direction of the heat insulating panel.

This facilitates the joining of the heat insulating panels along the vertical axial direction of the low temperature cargo tank, and enables alleviating the stress generated on the heat insulating panel by the expansion and shrinkage of the tank surface.

BRIEF DESCRIPTION OF THE DRAWINGS

Embodiments of the present invention will be described in detail with reference to the following drawings.

FIG. 1(*b*) is an exploded view showing a complete heat insulating panel of the heat insulation covering structure shown in FIG. 1(*a*);

FIG. 3(*b*) is a fragmentary view taken in the direction of arrows of A—A of FIG. 3(*a*);

FIG. 5(*b*) is a schematic sectional view of the slit part shown in FIG. 4 at the time of mounting;

FIG. 5(*c*) is a schematic sectional view of the slit part at the time of cooling;

FIG. 6(*b*) is a front view of the heat insulating panel shown in FIG. 1 when the heat insulating panel has been just mounted on the south hemisphere of the spherical tank;

FIG. 7(*b*) is a front view of the heat insulating panel shown in FIG. 1 when the heat insulating panel has just been mounted on the north hemisphere of the spherical tank;

FIG. 8(*b*) is a schematic perspective view showing a second example of the step stacking joint of heat insulating panels shown in FIG. 1;

DESCRIPTION OF THE PREFERRED EMBODIMENT

Figure 12:
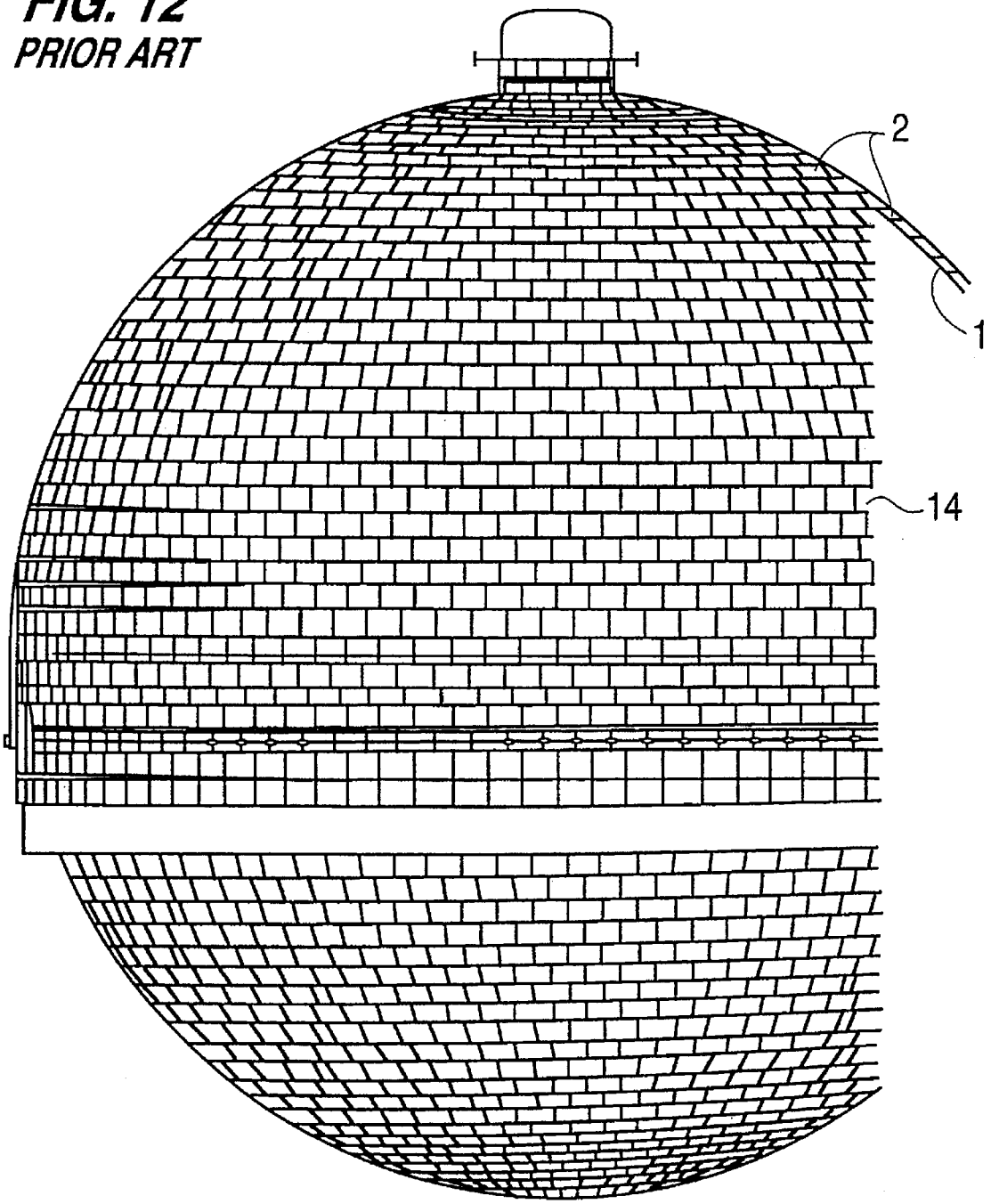
FIG. 12 PRIOR ART
FIG. 12 is a schematic view of the heat insulation coating structure of the conventional low temperature cargo tank.

In embodiments of the present invention shown in the drawings, a heat insulating panel 2 is mounted on a surface of a spherical tank 1 to provide a heat insulation covering as shown in a conventional spherical tank in FIG. 12.

Figure 1A:
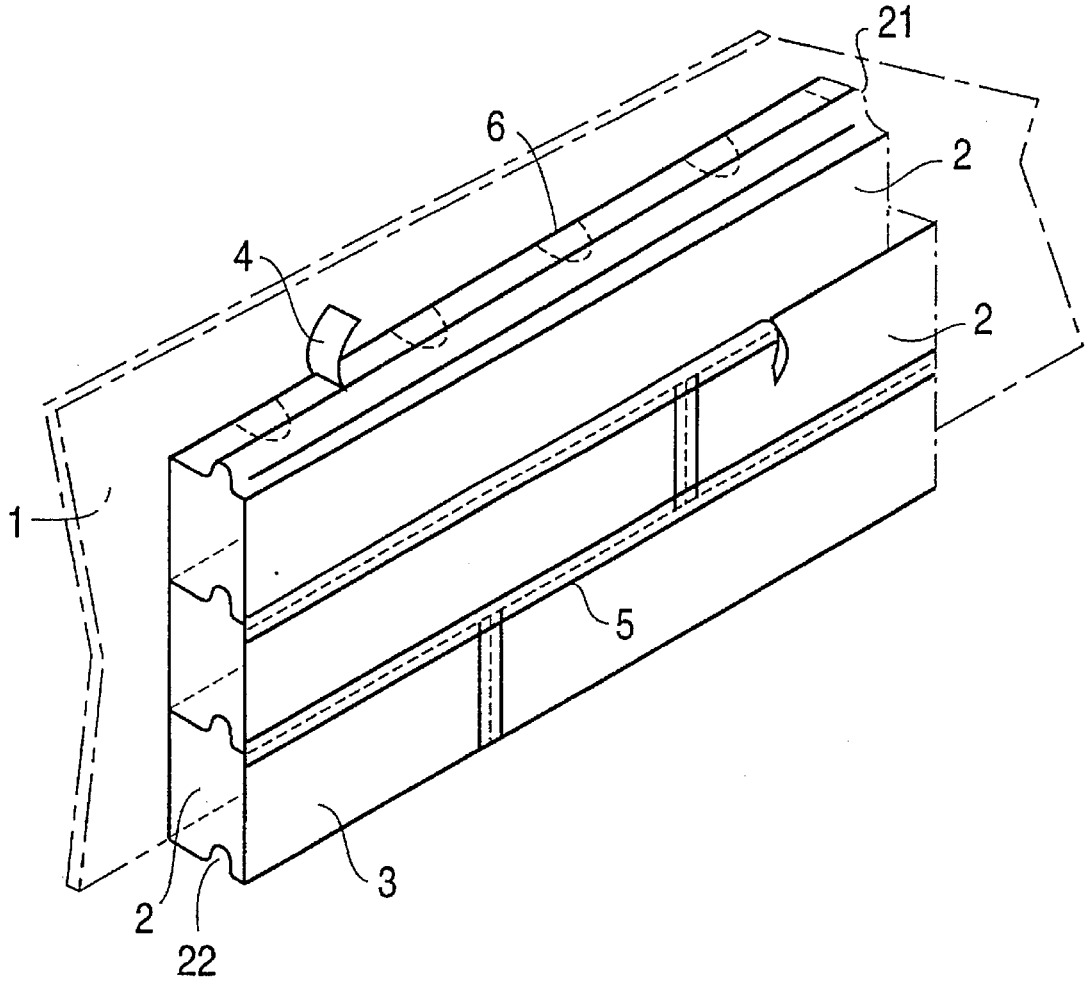
FIG. 1(*a*) is a perspective view showing an essential part of the heat insulation covering structure of the low temperature cargo tank according to one embodiment of the present invention.
Figure 2:
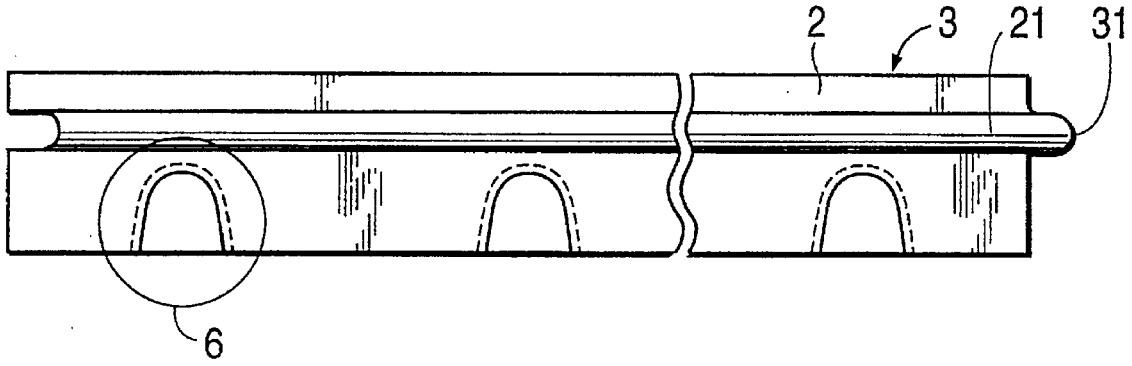
FIG. 2 is a plan view showing the heat insulating panel 5 shown in FIG. 1.
Figure 1B:
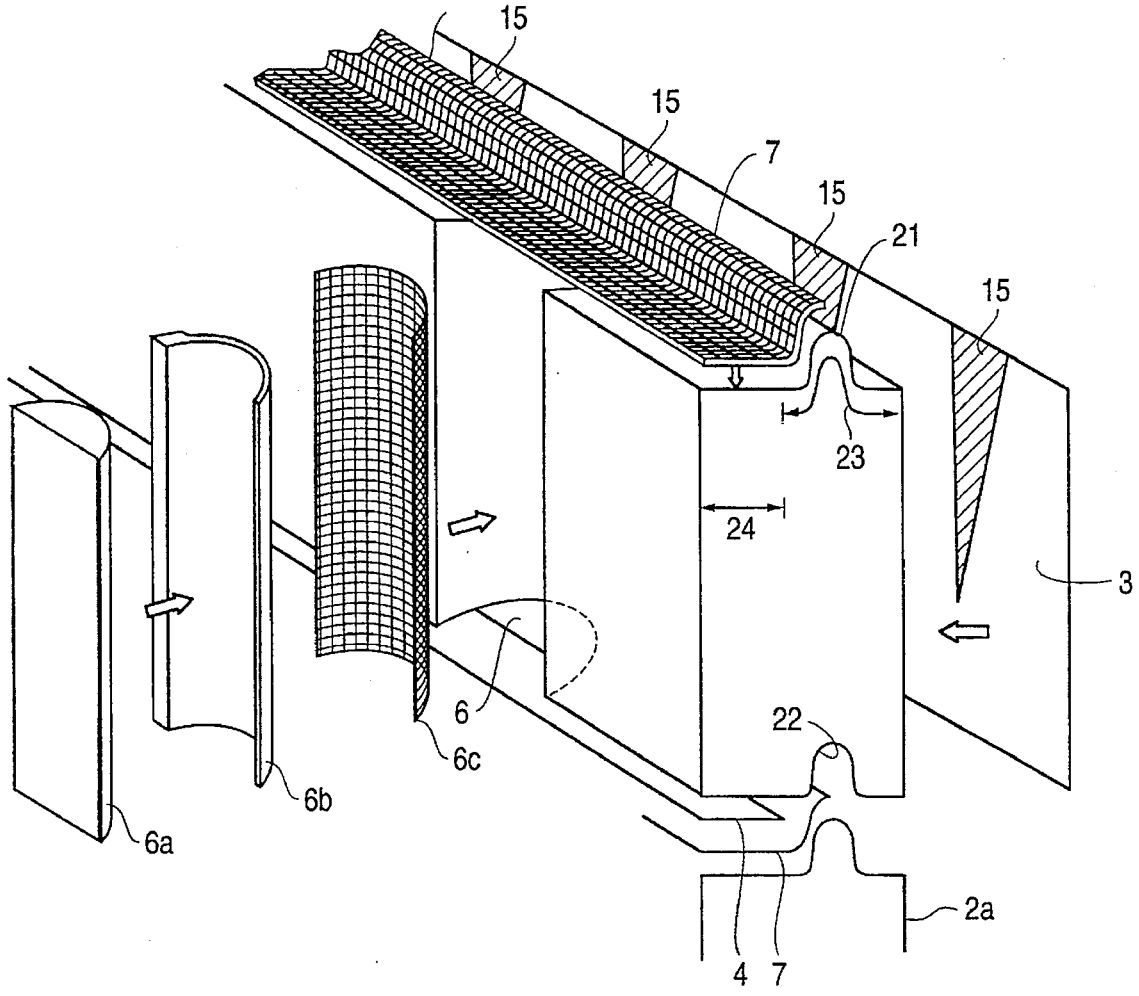
Figure 3A:
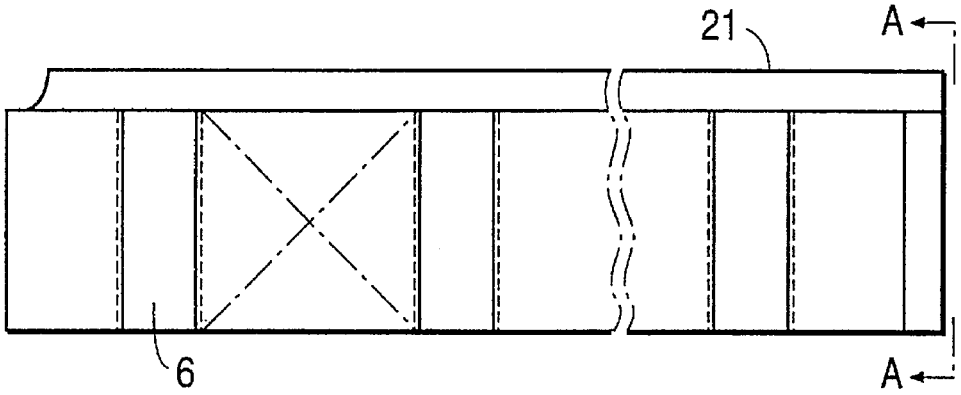
FIG. 3(*a*) is a front view showing an inside (low temperature side) of the heat insulating panel shown in FIG. 1.
Figure 3B:
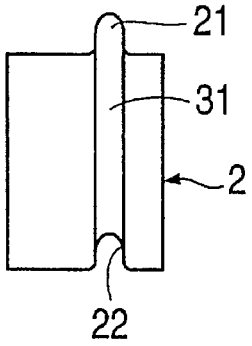

The heat insulating panel 2 according to the embodiment of the present invention is formed of a plastic foaming body such as polyurethane, polystyrene or the like. As shown in FIGS. 1 through 3, the whole heat insulating panel is formed into an elongated panel-like shape.

Further, reference numeral 3 designates a surface material provided on the normal temperature side (outside surface) of the heat insulating panel 2 to prevent infiltration of moisture into the heat insulating panel 2 and the corresponding mechanical damage. The surface material is formed of an aluminum foil, an aluminum/plastic laminating material, and an aluminum/glass cloth laminating material.

The slit parts 6 are equally spaced over the whole length of the heat insulating panel 2. Each of the parts 6 has a U-shaped cross section which extends to about one half of the panel depth from the low temperature side (inside surface) of the heat insulating panel 2 so that the heat insulating panel 2 can be constructed along the surface of the tank 1 whose curvature changes.

Figure 4:
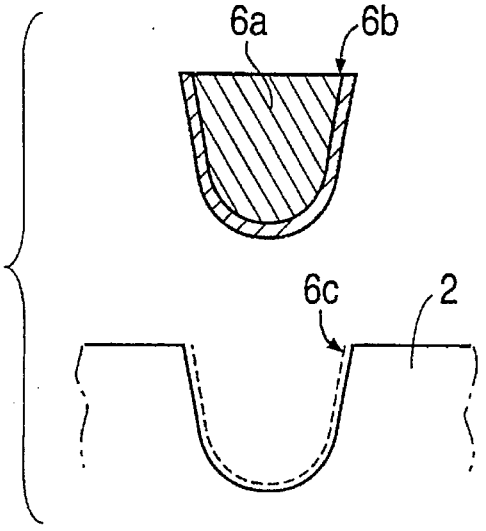
FIG. 4 is a schematic construction view of a slit part having a U-shaped cross section shown in FIG. 2.

As shown in FIG. 4, the slit part 6 includes a U-shaped plug 6*a* formed of the same material as the heat insulating panel 2. A glass cloth mesh 6*c* serves as a crack arrester and is adhered to the surface of a U-shaped groove provided on the heat insulating panel 2. Also, a heat insulating material 6*b* is provided between the U-shaped plug 6*a* and the glass cloth mesh 6*c*. The heat insulating material is expandable and shrinkable under extreme low temperatures, has an extremely small compression resistance, is capable of following the deformation of the heat insulating panel 2 at extreme low temperatures, and has an effect of preventing a convection.

Figure 5A:
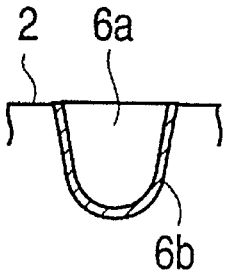
FIG. 5(*a*) is a schematic sectional view of the slit part shown in FIG. 4 at the time of the fabrication.
Figure 5B:
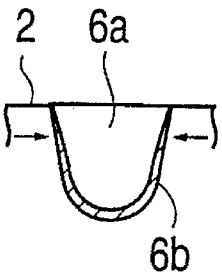
Figure 5C:
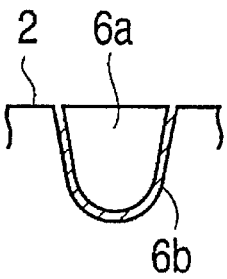

Polyamide, polyimide, melamine, phenol plastic foaming bodies are preferable as the heat insulating material 6*b*. Then, as shown in FIG. 5(*a*), the material 6*b* is assembled between the U-shaped groove and the U-shaped plug 6*a*. The heat insulating material 6*b* is formed to an approximately uniform thickness at the time of manufacturing. Further, when the heat insulating material is mounted on the curved surface of the tank 1, the heat insulating material 6*b* is compressed with the deformation of the heat insulating panel. As shown in FIG. 5(*b*), the material runs along a arbitrary curvature of the construction surface.

When the tank surface is at a low temperature, the heat insulating panel 2 on the low temperature side shrinks due to the low temperature. The heat insulating material 6*b* restores the shrunken portion to form a uniform thickness as shown in FIG. 5(*c*). Further, in some cases, the heat insulating material 6*b* expands to alleviate the tensile stress generated in the heat insulating panel 2.

Further, the slit part 6 is provided in the U-shaped groove, and assumed to have as large a radius as possible on the bottom surface (rear) of the slit part thereby alleviating the stress concentration. Further, on the surface of the U-shaped groove, the glass cloth mesh 6*c* which serves as a crack arrester material is attached. Incidentally, in a further embodiment of the aforementioned slit part, the U-shaped plug 6*a* is formed of a heat insulating material with a weak compression force even at extremely low temperatures so that the heat insulating material 6*b* may be omitted.

Figure 6A:
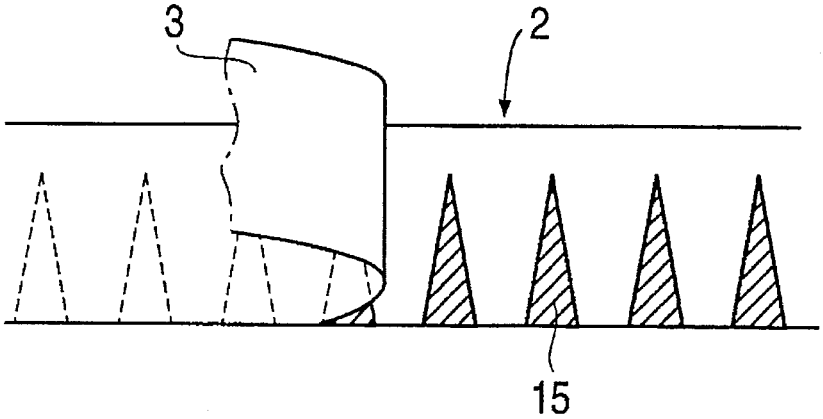
FIG. 6(*a*) is a front view of the outside (normal temperature side) of the heat insulating panel shown in FIG. 1 when the heat insulating panel is arranged in the south hemisphere of the spherical tank.
Figure 6B:
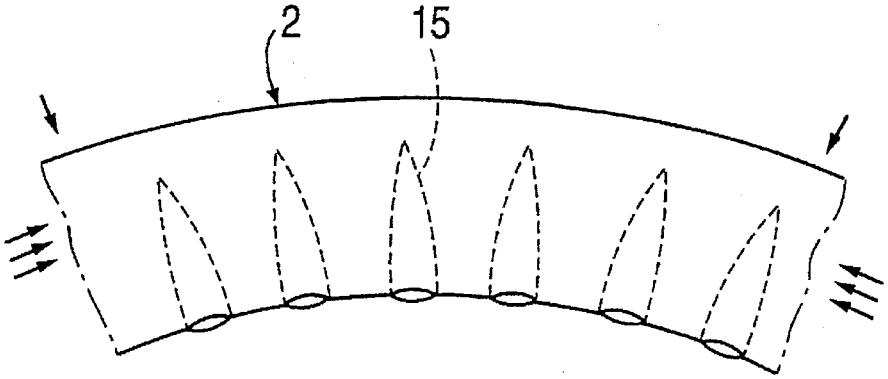
Figure 7A:
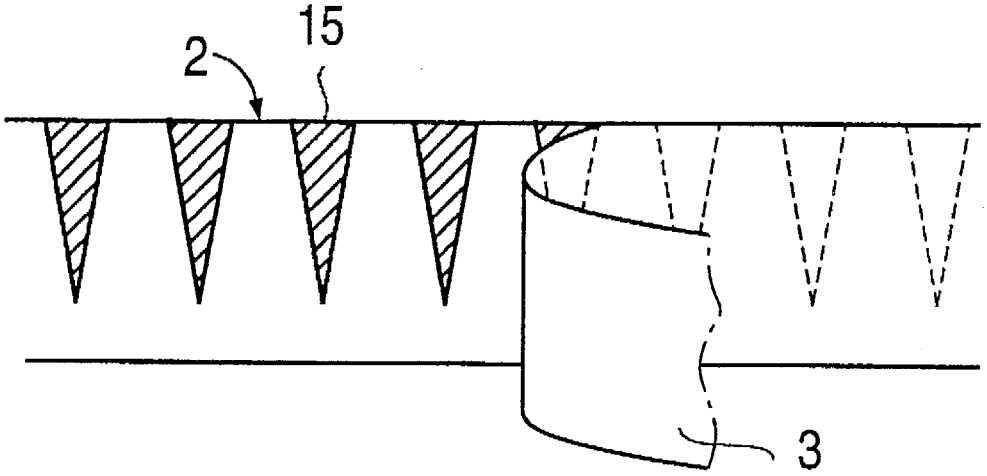
FIG. 7(*a*) is a front view of the outside (normal temperature side) of the heat insulating panel shown in FIG. 1 when the heat insulating panel is being arranged in the north hemisphere of the spherical tank.
Figure 7B:
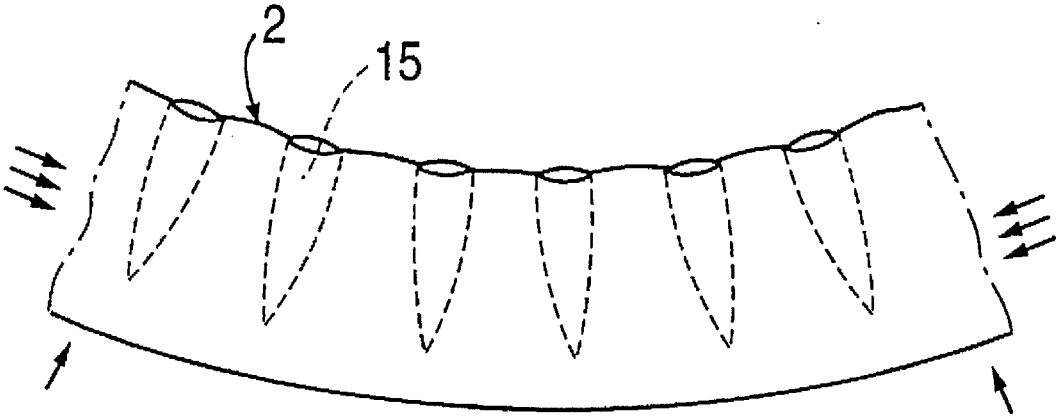

On the normal temperature side surface (outside surface) of the heat insulating panel 2, as shown in FIGS. 6 and 7, V-shaped and U-shaped non-bonding areas 15 are formed between the surface material 3 and the heat insulating panel 2 and are equally spaced over the whole length of the heat insulating panel 2 so that the heat insulating part 2 can be bent along the changing curvature of the construction surface. As a consequence, when the heat insulating panel 2 is bent along the surface of the tank 1, the surface material 3 of the non-bonding areas floats or lifts off of the outer panel surface so that the bending resistance of the surface material 3 is reduced thereby enabling easy bending of the heat insulating panel 2 together with the slit part 6 on the low temperature side.

Further, by providing the non-bonding areas 15 in this manner, warps generated when the heat insulating panel 2 is bent along the construction surface are absorbed by the V-shaped or the U-shaped non-bonding areas 15. Consequently, there is no longer any fear that warps, generated at random on the surface material at the time of whole surface bonding, will be generated and that surface material cracks will develop due to repetition of the bending.

In other words, for example, in the southern hemisphere of the spherical tank 1, a heat insulating panel 2 is placed on the tank surface as shown in FIG. 6(*a*). Then, as shown in FIG. 6(*b*), the heat insulating panel 2, at the time of mounting on the tank surface, is deformed into an arc shape such that the panel is bent downward and the whole shape is formed in such a manner that the upper end length is longer than the lower end length.

As a result, the lower side of the heat insulating panel 2 is compressed and shortened in length. At this time, the non-bonding areas 15 of surface material 3 rise in a V-shaped configuration. As a consequence, the aforementioned deformation of the heat insulating panel 2 is not inhibited by the surface material 3 so that the heat insulating panel 2 is smoothly deformed. Therefore, the heat insulating panel 2 can be easily attached to the tank surface of the spherical tank 1. In this embodiment, the V-shaped non-bonding areas are provided. However, the non-bonding area is not limited to the V-shape of the present invention. For example, a U-shape may be adopted.

Further, in the northern hemisphere of the spherical tank 1, the heat insulating panel 2 can be deformed from the state shown in FIG. 7(*a*) to an arc shape shown in FIG. 7(*b*) so that the heat insulating panel 2 can be easily mounted on the tank surface.

The step stacking joint structure of the heat insulating panel 2 will be explained in conjunction with FIG. 8(*a*).

On one end surface (upper side end surface) of the heat insulating panel 2, a projection 21 shifted to the outside from the center is provided over the entire length of the heat insulating panel 2 in the longitudinal direction.

On the other end surface (lower end surface) of the heat insulating panel 2, a depression or recess 22, shifted to the outside from the center, which corresponds to the projection 21A of an adjacent heat insulating panel 2A (which is distinguished from the heat insulating panel 2 by attaching an auxiliary symbol A) is formed along the entire length of the heat insulating panel 2.

Further, a crack arrester (glass cloth mesh) 7 is attached to the end surface of the heat insulating panel in the vicinity of the top of the projection 21 to the low temperature (inside) edge of the heat insulating panel 2.

Further, at the time of stacking, a film 4, made of polyester or the like, is provided between the upper surface of the crack arrester 7 and a lower end surface of the heat insulating panel 2 to prevent convection of the crack arrester 7, to form a depression slit 22, and to regulate the bonding area.

The film 4 serves to prevent the convection and serves to separate the adherence between the heat insulating panels 2 and 2A. In addition to film, paper or a composite of paper and plastic film may be used.

By providing the film 4, heat insulating panels 2 and 2A have non-bonding part 24 on the low temperature side (inside) and a bonding part 25 including the projection 21 on the normal temperature side (outside). Reference numeral 23 designates a coating area of adhesive.

With this structure, when a tensile stress works on the low temperature side, this non-bonding part 24 forms a slit and opens a little thereby alleviating the stress of the heat insulating panel in the stacking direction. The crack arrester 7 is provided for alleviating stress and preventing the progress of cracks resulting from stress concentrations at the bonding and non-bonding boundary surface.

The crack arrester 7 is attached on the low temperature side of the heat insulating panel 2 and serves to prevent the progress of cracks in the depth direction.

The crack arrester 7 is not limited to this embodiment. The crack arrester 7 can be inserted as shown in FIG. 8(*b*) to have the effect of preventing the progress of cracks. As variations, many kinds of crack arresters are available. The point is that the crack arresters are mounted in the vicinity of the connecting part.

Figure 8A:
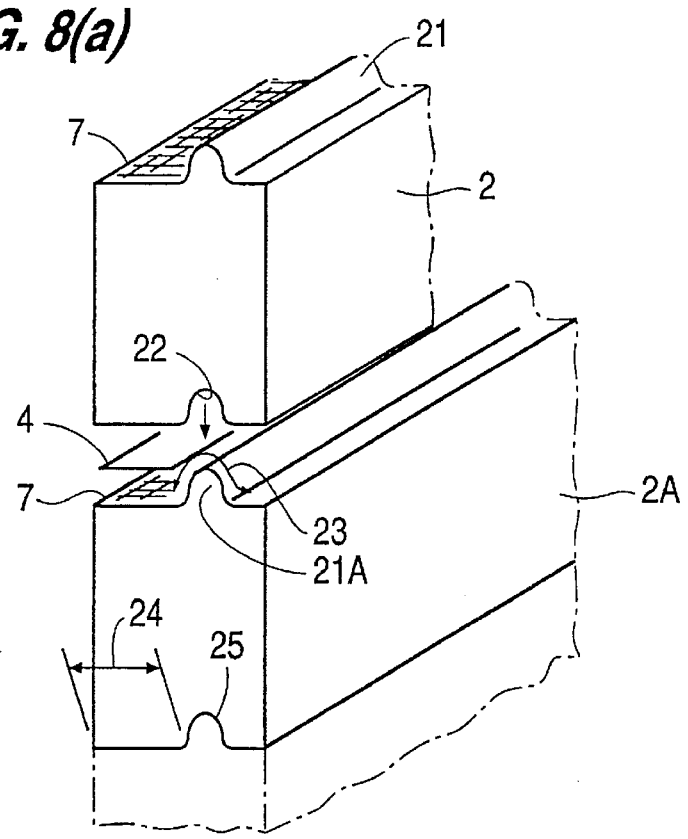
FIG. 8(*a*) is a schematic perspective view showing a first example of a step stacking joint of heat insulating panels shown in FIG. 1.
Figure 8B:
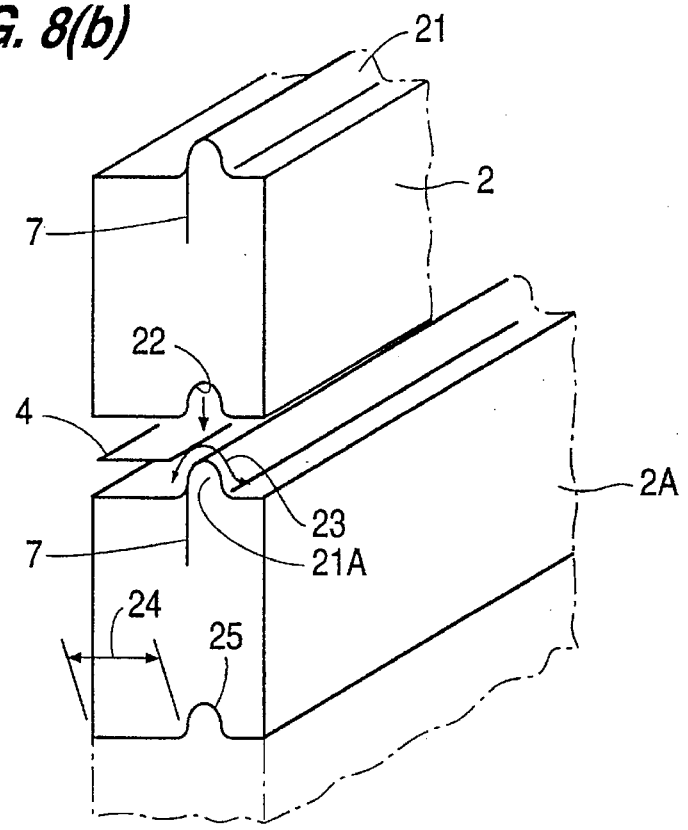
Figure 9:
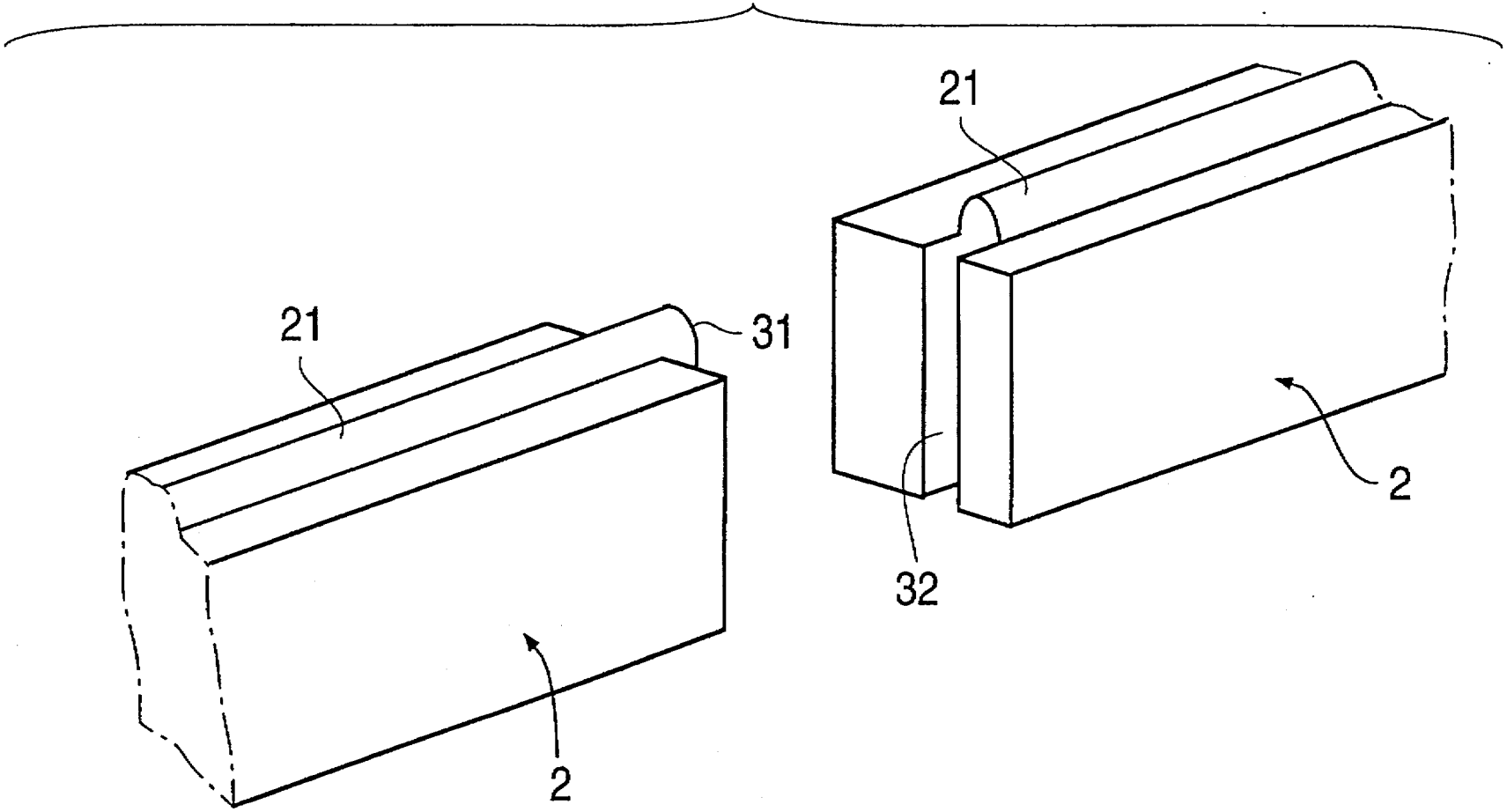
FIG. 9 is a schematic view showing a lengthwise direction joint of the heat insulating panel shown in FIG. 1.

As shown in FIG. 9, in a joint of the heat insulating panel 2 in the longitudinal direction, a projection 31 and a depression groove or recess 32, same as the case shown in FIG. 8(*a*) are formed on opposing end surfaces of the heat insulating panels 2, respectively. The projection and depression are mutually interfitted to join the entire surfaces. Even when simple planes are bonded and joined together without the projection 31 and the depression groove 32, there is no problem when the planes are joined with accuracy.

With respect to the heat insulating panel 2 having the aforementioned structure, for example, a mold foam polyurethane is supplied to manufacture a heat insulating panel formed of a plastic foam body having a shape of an elongated column-like configuration as shown in FIG. 2. Also, the U-shaped groove 6 and projection 21 are formed on the plastic foam body.

At this time, the surface material 3 can be attached simultaneously by positioning the surface material 3 in the mold in advance. Also, as shown in FIGS. 6 and 7, a large number of equally spaced V-shaped non-bonding areas 15 are provided.

The slit part 6 is completed by using, in the U-shaped groove, an expandable plastic foam formed of polyimide foam or the like (expandable heat insulating material) 6*b*, a U-shaped plug 6*a* formed of polyurethane foam, and a crack arrester 6*c* formed of glass cloth as shown in FIG. 4.

Figure 10:
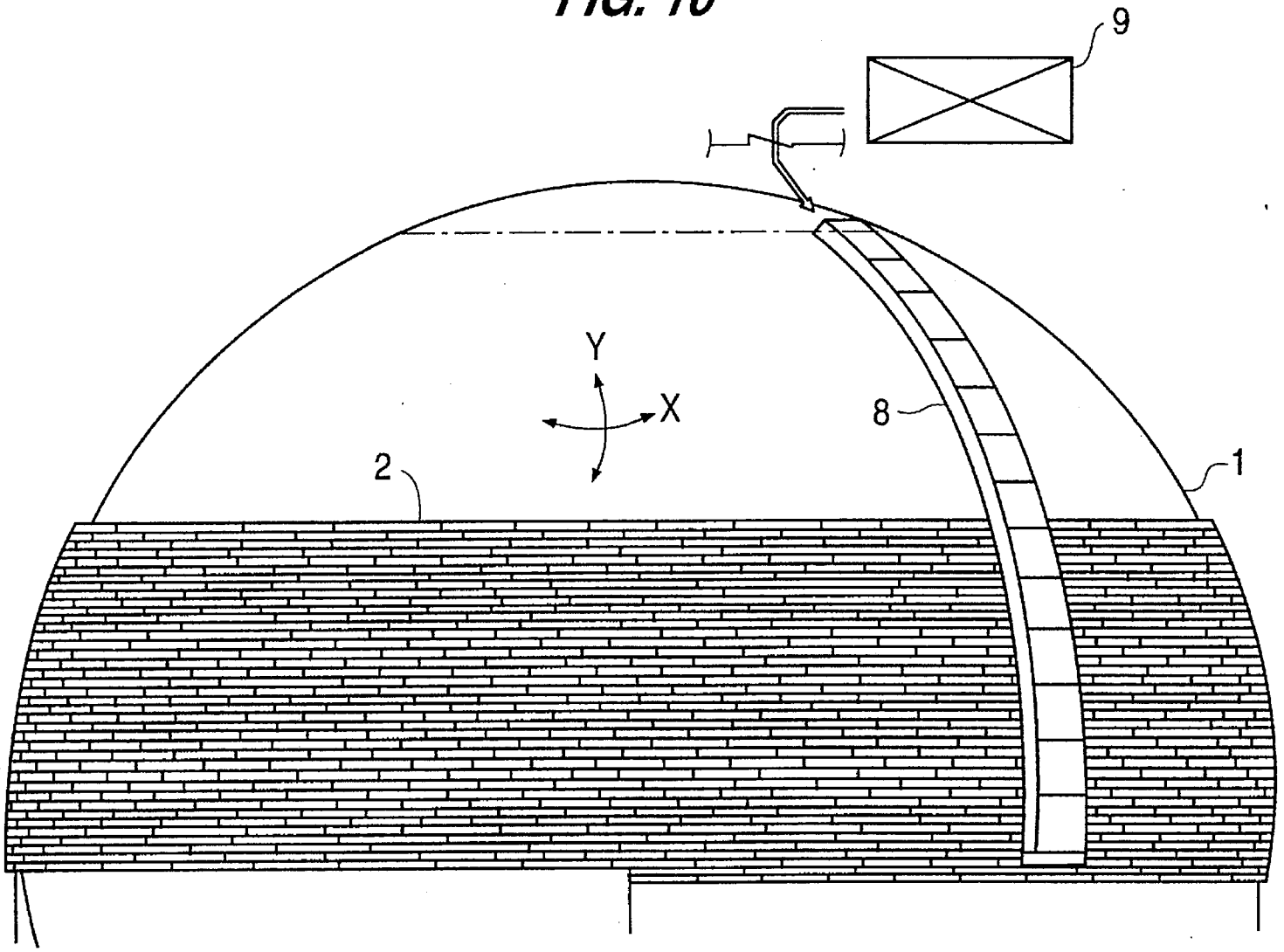
FIG. 10 is a schematic view showing an outline of mounting of the heat insulating panel shown in FIG. 1 onto the tank surface of the spherical tank.

Next, a convection preventing plastic film 4 shown in FIG. 1 is stuck to the connection part to form the heat insulating panel 2. The elongated column-like heat insulating panel 2 manufactured in this manner, is then carried into the construction site from the storage warehouse 9 as shown in FIG. 10.

At the construction site, the rotating footing 8 is used to carry the heat insulating panel 2 to the position where the spherical tank 1 is mounted.

Figure 11:
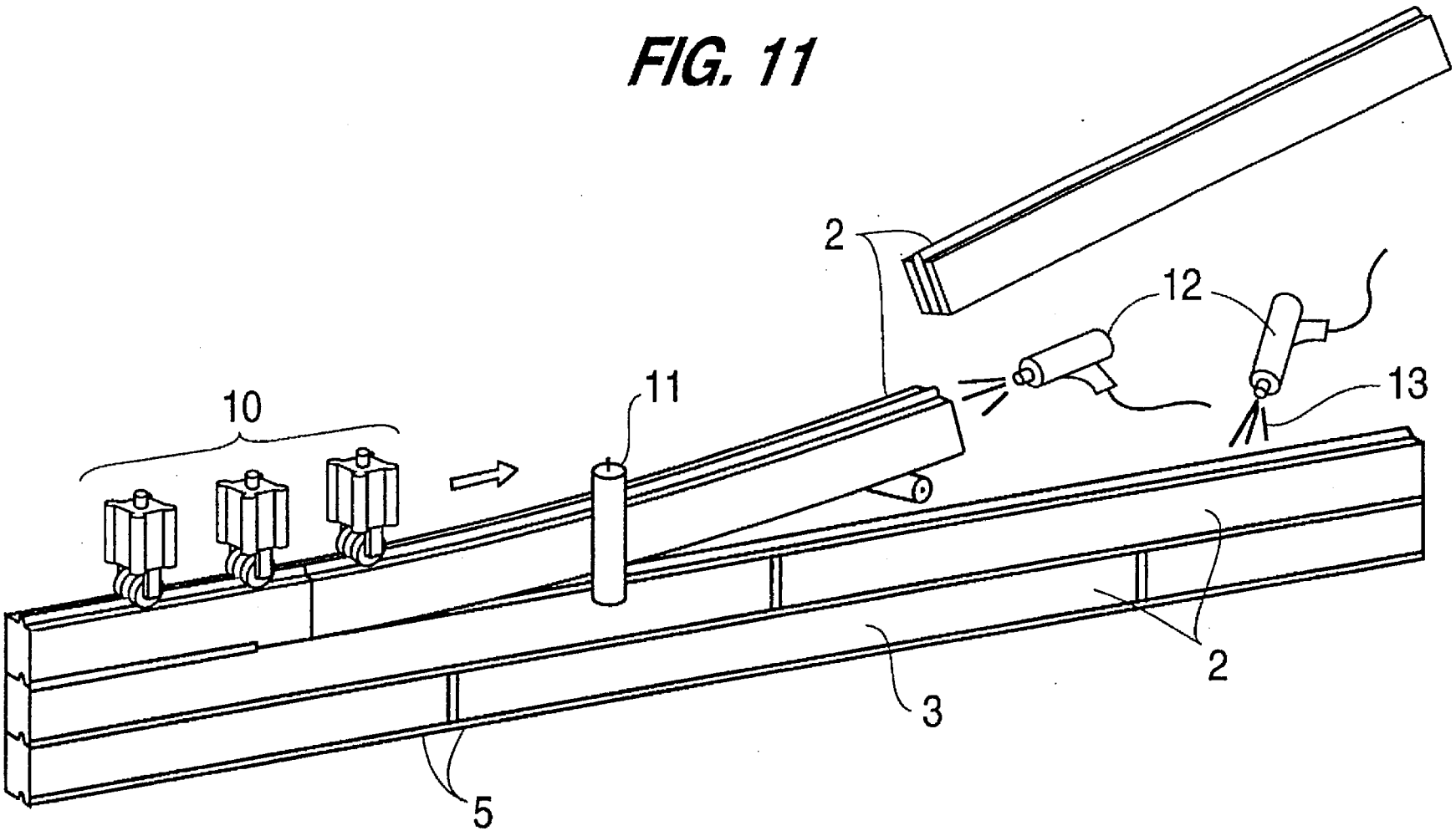
FIG. 11 is a schematic view showing an outline of mounting of the heat insulating panel shown in FIG. 1 onto the tank surface.

Then, as shown in FIG. 11, after the heat insulating panels 2 are successively connected on a tank surface of the spherical tank 1 in the horizontal direction thereby completing one circle, the heat insulating panels 2 are stacked along the vertical direction. At this time, adhesive 13 is applied to a required portion with an adhesive application device 12.

This work is performed by using a mounting jig 10, a guide roller 11, a tape or the like to attach a column-like heat insulating panel 2 in serial order from the bottom to the top.

Lastly, moisture proof tape 5 is adhesively mounted on a bonding part as surface treatment.

In this manner, this embodiment provides the following advantages.

(1) Since the heat insulating panel 2 is formed of a simple elongated panel-like configuration, the manufacturing cost and construction cost can be reduced.

(2) The stress can be dispersed by providing a U-shaped slit part on the heat insulating panel 2. At the same time, to alleviate a tensile stress generated by a thermal stress on the low temperature side, the initial compression stress can be used which is generated by bending of the panel at the time of construction.

(3) When the heat insulating panel 2 is bent in accordance with the curvature of the tank, the slit parts 6 function to avoid stress concentrations. Since a crack arrestor 6*c*, such as glass cloth or the like is bonded with the heat insulating panel 2, there is no fear that cracks or the like will be generated on the heat insulating panel 2 when the panel is bent in accordance with the curvature.

(4) Because a polyamide, polyimide, phenol, or melamine heat insulating material that is flexible under an extremely low temperature is embraced between the U-shaped slit part 6 and the groove convection can be prevented.

(5) When the material 3 is bonded on the entire surface of the insulating panel 2, it is difficult to bend the heat insulating panel in accordance with the curvature of the tank. Therefore, when V-shaped non-bonding areas 15 are provided, part of the surface material 3 floats, so the heat insulating panel 2 can be easily bent.

(6) To prevent convection and to control the area of adhesion, paper or a plastic film (or a composite thereof) 4 is inserted between an upper and a lower connection part of adjacent heat insulating panels 2. Therefore, since the low temperature side of the upper and lower connection part is formed of the non-bonding structure, a slit or gap will be formed on the low temperature side of the connection part with the result that the stress is alleviated.

Incidentally, in the aforementioned embodiment, to provide flexibility, the U-shaped slit part 6 is formed on the heat insulating panel 2. However, the present invention is not limited to the shape of the slit part which is shown as formed in a U shape. The shape need not be particularly a U-shaped configuration as long as the shape can avoid the stress concentration.

Further, with respect to the connection part of the heat insulating panels 2 (see FIGS. 8 and 9), the shape is not limited to the shape in the aforementioned embodiment as long as the stress can be alleviated.

Further, the convection preventing film such as the plastic film 4 or the like which is inserted into the connection part may be preliminarily laminated at factories as shown in the embodiment, or may be laminated at the construction site at the time of construction of the panel.

Further, in accordance with the aforementioned embodiment, polyurethane foam is charged and foamed in a mold for manufacturing the heat insulating panel. However the method of manufacture is not limited to the above and the heat insulating panel can be manufactured by separating the board like plastic foam from the block. In such a case, general materials such as polyurethane foam, polystyrene foam or the like may be used. Preferably, polyurethane foam may be used in consideration of heat conduction rate.

Further, in the aforementioned embodiment, the non-bonding part formed between the surface material 3 and the heat insulating panel 2 may be in a V-shape or a U-shape configuration. The shape is not limited to the above but the non-bonding part may be of any shape as long as no separation is generated between the surface material and the heat insulating panel when the heat insulating panel is bent.

What is claimed is:

1. A heat insulation structure for forming a covering layer on a low temperature cargo tank, said structure comprising:

a panel having an elongated configuration, an inner side engagable with a tank surface, an outer side, and a longitudinal axis which is adapted to extend parallel to a horizontal axis of the tank when said panel is positioned on a surface of the tank, said panel further having a plurality of U-shaped recesses formed in said inner side of said panel; and a plurality of U-shaped members positioned in said plurality of U-shaped recesses, respectively, wherein said plurality of recesses are equally spaced longitudinally along said inner surface of said panel and extend orthogonally relative to said longitudinal axis of said panel.

2. The heat insulation structure as claimed in claim 1, wherein each of said plurality of U-shaped members comprises:

a crack arrester attached to a surface of said respective recess;

an elongated plug having a U-shape cross-section and being formed of the same material as said panel, said elongated plug being fittable in said respective U-shaped recess; and a heat insulating material positioned between said elongated plug and said respective recess.

3. The heat insulation structure as claimed in claim 2, further comprising:

a moisture proof material adhered to the outer surface of said panel, said moisture proof material adhering to said outer surface of said panel except at a plurality of V-shaped or U-shaped areas at which said moisture proof material does not adhere to said outer surface of said panel, wherein said V-shaped or U-shaped areas are intermittently located along an edge of said panel so that said moisture proof material at said plurality of V-shaped or U-shaped non-adhering areas moves away from said outer surface of said panel upon compressing said panel upon application to a curved tank surface.

4. The heat insulation structure as claimed in claim 2, wherein said panel further comprises:

a first end surface extending between said inner side and said outer side;

a second end surface, located opposite said first end surface, extending between said inner side and said outer side;

a projection formed on one of said first end surface and said second end surface; and a depression formed on the other of said first end surface and said second end surface.

5. The heat insulation structure as claimed in claim 4, further comprising:

a film provided on an inner portion of said other of said first end surface and said second end surface to define a non-adhering area, wherein said film defines said non-adhering area when said heat insulation structure is provided on a tank surface and connected to adjacent heat insulation structures.

6. The heat insulation structure as claimed in claim 1, wherein each of said plurality of U-shaped members comprise:

a crack arrester attached to a surface of said respective recess;

an elongated plug having a U-shaped cross-section and being formed of the same material as said panel, said elongated member being fittable in said respective U-shaped recess; and a heat insulating material positioned between said elongated plug and said respective recess, said heat insulating material exhibiting a weak compression force even under extreme low temperatures.

7. The heat insulation structure as claimed in claim 6, further comprising:

a moisture proof material adhered to the outer surface of said panel, said moisture proof material adhering to said outer surface of said panel except at a plurality of V-shaped or U-shaped areas at which said moisture proof material does not adhere to said outer surface of said panel, wherein said V-shaped or U-shaped areas are intermittently located along an edge of said panel so that said moisture proof material at said plurality of V-shaped or U-shaped non-adhering areas moves away from said outer surface of said panel upon compressing said panel upon application to a curved tank surface.

8. The heat insulation structure as claimed in claim 6, wherein said panel further comprises:

a first end surface extending between said inner side and said outer side;

a second end surface, located opposite said first end surface, extending between said inner side and said outer side;

a projection formed on one of said first end surface and said second end surface; and a depression formed on the other of said first end surface and said second end surface.

9. The heat insulation structure as claimed in claim 8, further comprising:

a film provided on an inner portion of said first end surface to define a non-adhering area, wherein said film defines non-adhering area when said heat insulation structure is provided on a tank surface and connected to adjacent heat insulation structures.

10. The heat insulation structure as claimed in claim 1, further comprising:

a moisture proof material adhered to the outer surface of said panel, said moisture proof material adhering to said outer surface of said panel except at a plurality of V-shaped or U-shaped areas at which said moisture proof material does not adhere to said outer surface of said panel, wherein said V-shaped or U-shaped areas are intermittently located along an edge of said panel so that said moisture proof material at said plurality of V-shaped or U-shaped non-adhering areas moves away from said outer surface of said panel upon compressing said panel upon application to a curved tank surface.

11. The heat insulation structure as claimed in claim 10, wherein said panel further comprises:

a first end surface extending between said inner side and said outer side;

a second end surface, located opposite said first end surface, extending between said inner side and said outer side;

a projection formed on one of said first end surface and said second end surface; and a depression formed on the other of said first end surface and said second end surface.

12. The heat insulation structure as claimed in claim 11, further comprising:

a film provided on an inner portion of said first end surface to define a non-adhering area, wherein said film defines said non-adhering area when said heat insulation structure is provided on a tank surface and connected to adjacent heat insulation structures.

13. The heat insulation structure as claimed in claim 1, wherein said panel further comprises:

a first end surface extending between said inner side and said outer side;

a second end surface, located opposite said first end surface, extending between said inner side and said outer side;

a projection extending along the length of one of said said first end surface and said second end surface; and a depression formed on the other of said first end surface and said second end surface.

14. The heat insulation structure as claimed in claim 13, further comprising:

a film provided on an inner portion of said first end surface to define a non-adhering area, wherein said film defines said non-adhering area when said heat insulation structure is provided on a tank surface and connected to adjacent heat insulation structures.

15. The heat insulation structure as claimed in claim 14, further comprising a crack arrestor positioned along the length of said first end surface and extending between a high point of said projection and an edge of said inner side of said panel.

* * * * *